United States Patent [19]

Nishida et al.

[11] Patent Number: 4,609,338

[45] Date of Patent: Sep. 2, 1986

[54] APPARATUS FOR PRESSURE MOLDING FIREBRICK

[75] Inventors: Shinji Nishida; Takashi Otsuka; Yoshio Nakamori; Mitsukuni Sato, all of Okayama, Japan

[73] Assignee: Shinagawa Shirorenga Kabushiki Kaisha, Tokyo, Japan

[21] Appl. No.: 696,903

[22] Filed: Jan. 31, 1985

[30] Foreign Application Priority Data

Feb. 15, 1984 [JP] Japan ..... 59-25100

[51] Int. Cl.[4] ..... B28B 17/00

[52] U.S. Cl. ..... 425/149; 425/432

[58] Field of Search ..... 425/149, 432

[56] References Cited

U.S. PATENT DOCUMENTS

| | | | |
|---|---|---|---|
| 2,959,900 | 11/1960 | Wallett | 425/139 X |
| 4,035,124 | 7/1977 | Balhorn | 425/139 |
| 4,235,580 | 11/1980 | Springs et al. | 425/432 X |
| 4,238,177 | 12/1980 | Erile et al. | 425/432 X |
| 4,244,682 | 1/1981 | Willingham | 425/432 X |

*Primary Examiner*—J. Howard Flint, Jr.
*Attorney, Agent, or Firm*—Parkhurst & Oliff

[57] ABSTRACT

A fluid operated press having opposed first and second fluid chambers is employed for compressing a mixture of desired brick ingredients in a mold. Pressurized fluid, preferably hydraulic oil, is first delivered to the first fluid chamber of the press to cause the same to exert a prescribed pressure on the mixture. Then, with this prescribed pressure maintained, the pressurized fluid is directed alternately into the first and second fluid chambers at rapid intervals, with the result that the press imparts vibratory motion to the mixture being held under pressure. In a preferred embodiment, the selective delivery of the pressurized fluid to the fluid chambers of the press is controlled by a servomechanism, constantly comparing a reference pressure signal with an actual pressure signal representative of the actual pressure being exerted by the press and actuating a servovalve so as to make the difference between the reference and actual pressure signals zero.

5 Claims, 4 Drawing Figures

APPARATUS FOR PRESSURE MOLDING FIREBRICK

BACKGROUND OF THE INVENTION

This invention belongs to the art of brickmaking and pertains more specifically to a method of, and apparatus for, pressure molding refractory brick commonly termed firebrick. Still more specifically, the invention is directed to such a method and apparatus whereby a mixture of desired firebrick ingredients in a mold is subjected to both pressure and vibrations for more efficient fabrication of high quality firebrick, particularly of that containing graphite, than heretofore.

The pressure molding of firebrick by presses such as a friction press and hydraulic press has been known and practiced in the brickmaking industry. With the recent advent of graphite-containing firebrick, however, the conventional brickmaking equipment has proved to be in need of improvement for higher production. Standard methods of molding graphite-containing firebrick have been either to increase the molding pressure to 1.0 to 3.0 tons per square centimeter, as compared with 0.5 to 1.0 ton per square centimeter required for the fabrication of common firebrick, or to repeat the application of pressure a number of times by a friction press.

Generally, for the pressure molding of firebrick, there is first prepared a mixture of refractory aggregate in the form of both coarse and fine particles and a binder with air entrapped in the mixture. Placed in a mold, the mixture is pressed to cause the coarse and fine aggregate particles to be bound to one another in practically the most closely packed state. High bulk density (metric units) or bulk specific gravity and low porosity are the requisites of high quality firebrick. Conventional measures for the attainment of these properties have been to increase the packed density of the mixture of brick ingredients within a metal mold at the time of pressing and forming thereby to obtain uniformity and to carry out deaeration by degassing.

However, such conventional measures have proved unsatisfactory in the case of graphite-containing firebrick. The mixture to be processed into this class of firebrick contains from 15 to 20 percent by weight of graphite as particles of uniform and balanced distribution. When the mixture is pressed, these graphite particles exhibit a unique behavior not found in the fabrication of common firebrick. Not only are the fine graphite particles themselves elastic, but they also possess even greater elasticity as a mass. This is because of a large volume of air trapped in the interstices of the graphite particles and of their great surface energies. Having a low coefficient of friction, moreover, the graphite particles very easily slip relative to each other. For these reasons the graphite-containing mixture subjected to pressing tends to regain its initial state as an elastic body.

Thus, for a higher bulk specific gravity of graphite-containing firebrick fresh from the press, it is essential to reduce the elastic properties of the firebrick mixture before it is pressed. (It is to be noted that the term "bulk specific gravity" as used in this specification means that of the green brick that has just been pressed.) The brickmaking industry has recently expended much research effort for the solution of this problem.

We have conducted a series of exhaustive experiments and have amassed data concerning how the bulk specific gravity of a graphite-containing firebrick is affected by the compositions and particle sizes of the mixed raw materials, the molding pressures, and the number of bumping impacts or pressures exerted on the mixtures. The data indicate that the repeated exertion of impacts or pressures serves to improve the bulk specific gravity, but up to a limit of approximately 20 times from the standpoint of production engineering. Also, the higher the molding pressure, the greater is the bulk specific gravity, and this tendency becomes even more pronounced in cases where the mixtures of raw materials contain a large proportion of fine particles. At the same molding pressure, however, the bulk specific gravity decreases in inverse proportion with the percentage of fine particles contained; that is, a higher molding pressure is required for the same bulk specific gravity.

Both friction press and hydraulic press have their own restrictions and limitations as heretofore used for pressure molding firebrick. The friction press is an inertia operated machine, translating the rotation of a flywheel into linear motion of a screw shaft. It has generally been employed for applying a series of impact forces or blows on the mixture in a mold. Problems arise, however, in increasing the size of the friction press to an extent required for the exertion of sufficiently high molding pressures for the fabrication of graphite-containing firebrick. The operating principle of the friction press unavoidably gives rise to considerable energy losses. No negligible proportion of the mechanical energy created by the rotation of the flywheel is wasted in the form of the heat of friction between the screw shaft and the mating part and of vibration and noise upon application of blows. Moreover, as the bulk specific gravity of the mixture being pressed rises close to the limit, the impact of each blow is transmitted amost directly to the machine itself, possibly resulting in its damage. Any attempt to increase the size of the friction press to an extent necessary for the production of graphite-containing firebrick is, therefore, impractical.

The hydraulic press, on the other hand, exerts semistatic pressures and operates with little noise and little energy loss. The manufacture of large size hydraulic presses is also relatively easy. The problem is that graphite-containing firebrick of truly satisfactory physical properties is not obtainable no matter how high the semistatic pressures of the hydraulic press are made.

Accordingly, a method known as "bumping", which comprises the repeated (approximately 20 times) application of impact vibration caused by the maximum pressure of the hydraulic press on the mixture in a mold is being used. For the application of such repeated blows, a solenoid actuated directional control valve has been employed for alternately directing hydraulic oil under pressure into the pair of opposed fluid chambers of the press and hence for causing the repeated up-and-down motion of the ram.

An objection to the known bumping method is the prolonged length of time necessary for pressing each brick. Each blow has ordinarily required a period of five to six seconds, so that a total of as much as 100 to 120 seconds has been necessary for imparting 20 blows to each brick.

SUMMARY OF THE INVENTION

The present invention overcomes the problems heretofore encountered in the pressure molding of firebrick, particularly of that containing graphite, and makes possible the manufacture of firebrick of remarkably high bulk specific gravity in a shorter period of time than heretofore.

Briefly summarized in one aspect thereof, the invention provides an improved apparatus for carrying out the method of pressure molding firebrick, which method employs a press having opposed first and second fluid chambers to be selectively pressurized for respectively exerting pressure on, and releasing the pressure from, a mixture of desired brick ingredients in the form of fine particles in a mold. A fluid under pressure is first supplied into the first fluid chamber until the press exerts a prescribed pressure on the mixture. Then, with the mixture held substantially under the prescribed pressure, the pressurized fluid is alternately directed into the opposite fluid chambers of the press at such rapid intervals that the mixture is subjected to vibratory motion from the press while being thereby held under pressure, instead of to a series of discrete blows by the prior art bumping method, and so is rapidly compacted to a high bulk density or specific gravity.

According to another aspect of the invention, there is provided an apparatus for pressure molding firebrick in conformity with the above summarized method. The apparatus comprises, in addition to the fluid operated press, a directional control valve for selectively placing the opposed fluid chambers of the press in and out of communication with a source of fluid under pressure and with a fluid drain, and means for actuating the directional control valve so as to cause the same first to direct the pressurized fluid from the source to the first fluid chamber until the press exerts a prescribed pressure on the mixture and then, with the mixture held under the prescribed pressure, to direct the pressurized fluid from the source alternately to the fluid chambers of the press at rapid intervals.

Preferably, an electromagnetically actuated servovalve is employed for directing the pressurized fluid alternately to the opposite fluid chambers of the press. For actuating the servovalve, there is provided signal generator means which generates a reference pressure signal representative of the initial pressure to be exerted by the press on the mixture of powdered firebrick ingredients and of the intervals at which the pressurized fluid is to be alternately delivered to the opposite fluid chambers of the press. A pressure sensor is also provided for generating an actual pressure signal representative of the actual pressure being exerted by the press on the mixture. The reference and actual pressure signals are both directed into servo control means, which actuates the servovalve in accordance with the difference between the two input signals, so as to make the actual pressure of the press equal to that represented by the reference pressure signal.

Thus, in accordance with the invention, the mixture of powdered firebrick ingredients in a mold is subjected to vibrations or repeated pressure by the press while being thereby held under pressure. The vibrations of the press can be readily generated as the pressurized fluid is alternately delivered to the opposite fluid chambers of the press by the servovalve, which is faster in operation than its counterpart employed by the conventional bumping method. Indeed, in one preferred construction of the servovalve, the period of time required for one complete reciprocation of the press ram (i.e., for one vibration) is as short as from 1.0 to 1.5 seconds. If 20 such vibrations are to be imparted to the mixture for the production of one firebrick, the total time is only from 20 to 30 seconds, which is from $\frac{1}{2}$ to $\frac{1}{3}$ the time required conventionally by a friction press, and from $\frac{1}{4}$ to 1/5 the time required by the bumping method employing a hydraulic press.

The machine for use in the practice of this invention can, of course, be a hydraulic press. The hydraulic press can be easily increased in size for the exertion of pressures sufficient for the purposes of this invention without much noise production.

As an additional feature of the invention, the signal generator means for the production of the reference pressure signal can be so constructed, as in the preferred embodiment disclosed herein, to predetermine various conditions of pressure molding according to the compositions and particle sizes of the firebrick materials. Various types of firebrick may therefore be automatically produced under the predetermined optimum conditions.

It will thus be appreciated that the apparatus of the present invention is well adapted for the manufacture of firebrick which requires high molding pressures and the repeated application of such pressures. In particular, the invention will be of immense utility in increasing the production of graphite-containing firebrick.

The above and other features and advantages of this invention and the manner of realizing them will become more apparent, and the invention itself will best be understood, from a study of the following description and appended claims, with reference had to the attached drawings showing the preferred embodiment of the invention.

DESCRIPTION OF THE PREFERRED EMBODIMENT

Figure 1:
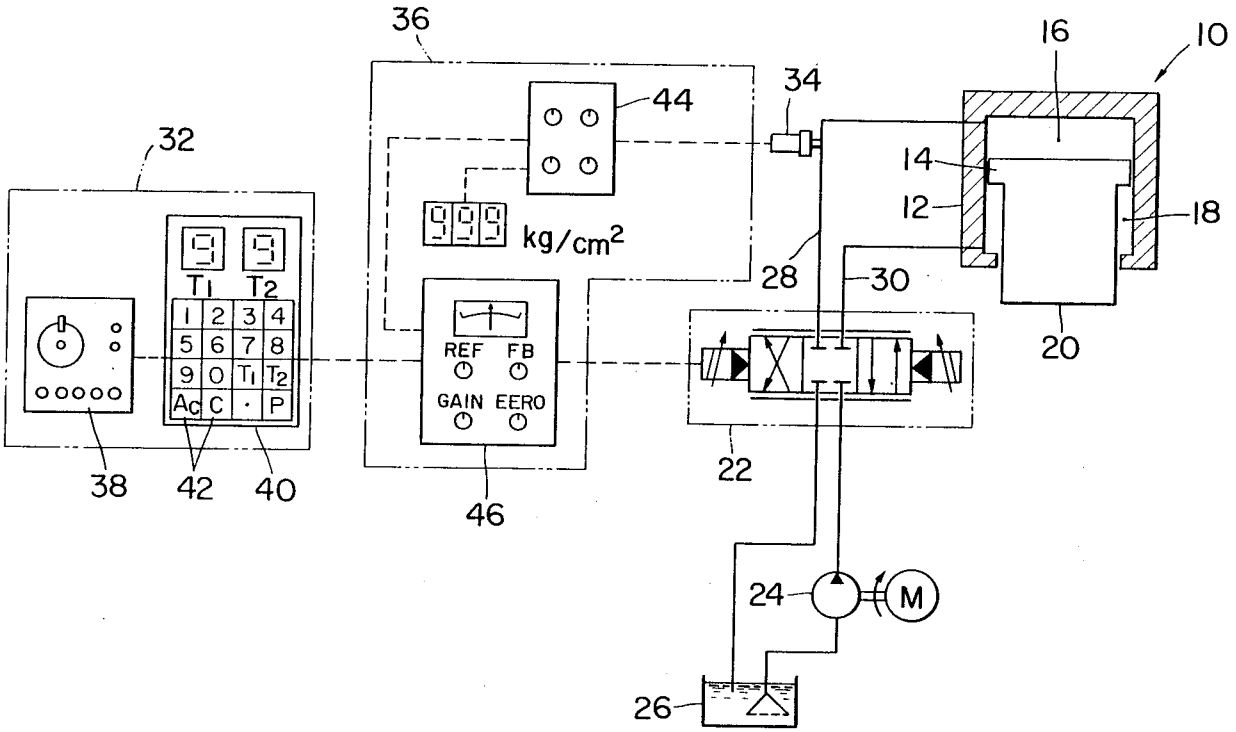
FIG. 1 is a diagrammatic representation of the apparatus for pressure molding firebrick constructed in accordance with the principles of this invention.

The general organization of the apparatus in accordance with the invention will be understood from a consideration of FIG. 1. Included is in this apparatus a fluid-operated, preferably hydraulic, press 10 having an upstanding cylinder 12. A piston 14 is reciprocatively fitted in this cylinder 12 to define a pair of opposed fluid chambers 16 and 18 therein. A ram 20 depends from the piston 14 and projects out of the cylinder 12 for acting on a mixture of desired firebrick materials in the form of fine particles contained in a mold (not shown).

A servovalve 22 is provided for selectively placing the opposed fluid chambers 16 and 18 of the press 10 in and out of communication with a hydraulic pump 24 and with a fluid drain or reservoir 26. The servovalve 22 is a four-way, three-position, closed-center, directional-control valve capable of infinite positioning. A preferred construction of the servovalve 22 includes a torque motor for electromagnetically translating an electric pilot signal into mechanical motion, a hydraulic amplifier for amplifying the mechanical motion, and flow and direction control means actuated by the fluid output of the hydraulic amplifier.

Normally held centered as shown, the servovalve 22 holds the opposed fluid chambers 16 and 18 of the press 10 out of communication with either of the pump 24 and drain 26. When actuated to the right, the servovalve 22 places the pump 24 in communication with the upper fluid chamber 16 of the press 10 by way of a conduit 28, thereby causing the descent of the piston 14 with the ram 20 for the exertion of pressure on the mixture in the mold. When actuated to the left, on the other hand, the servovalve 22 places the pump 24 in communication with the lower fluid chamber 18 of the press 10 by way of a conduit 30, thereby causing the ascent of the piston 14 with the ram 20 for the release of the pressure from the mixture in the mold.

According to the method, the press 10 first exerts a predetermined pressure on the mixture in the mold and then, with that predetermined pressure substantially maintained, applies vibrations to the mixture by the rapid reciprocation of the piston 14 with the ram 20.

In order to cause such operation of the press 10, the servovalve 22 is pilot operated by a servo system comprising a signal generator section 32 for generating an electric reference pressure signal representative of desired pressures to be exerted by the press, a pressure sensor 34 for generating an actual pressure signal representative of the actual pressure being exerted by the press, and a servo control section 36 for activating the servovalve 22 in response to the reference and actual pressure signals.

The signal generator section 32 comprises a variable-frequency oscillator 38 and its controller 40. The oscillator 38 is capable of generating an electric signal with frequencies ranging from 0.1 hertz to 1.0 megahertz. Preferably, the oscillator 38 is also capable of generating the variable-frequency signal with various waveforms, such as a square or rectangular wave, triangular wave, and sine wave, to impart correspondingly different modes of vibration to the powdered firebrick materials being pressed. The controller 40 has an array of digital pushbutton switches 42 to be depressed manually to determine such factors to be represented by the oscillator output signal as the initial pressure to be exerted on the mixture of firebrick materials in the mold, the frequency and period of the vibration to be subsequently applied to the mixture, etc. The waveform of the oscillator output signal can also be selected by the controller 40. The output from the signal generator section 32 is delivered as the reference pressure signal to the servo control section 36.

The pressure sensor 34 is communicatively connected to an intermediate part of the conduit 28 extending between the servovalve 22 and the upper fluid chamber 16 of the press 10 which is to be pressurized for the power stroke of the piston 14. The pressure sensor 34 senses the pressure being exerted by the press 10 from the pressure of the fluid flowing through the conduit 28 and puts out the actual pressure signal indicative of the actual pressure of the press at every moment. A pressure monitor including a conventional strain gage is a preferred example of the pressure sensor 34.

The servo control section 36 comprises an amplifier 44 for amplifying the actual pressure signal from the pressure sensor 34 and a servo amplifier 46 responsive to the reference pressure signal from the signal generator section 32 and to the amplified actual pressure signal from the amplifier 44, for actuating the servovalve 22 in accordance with the difference between the reference and actual pressure signals. The servo amplifier 46 functions in the known manner so as to make the actual pressure signal equal to the reference pressure signal.

Operation

The oscillator controller 40 of the signal generator section 32 may first be manipulated to determine the above noted conditions of pressure molding in accordance with the invention, as represented by the frequencies, waveform, etc., of the output signal of the variable frequency oscillator 38. Generally, there are two different methods for the determination of the moment at which the hydraulic press 10 starts imparting vibrations to the mixture of firebrick materials in the mold. One is to cause the oscillator 38 to start producing a signal at a desired frequency of the vibrations when the actual pressure being exerted by the press 10 on the mixture builds up to a prescribed value. The other is to cause the oscillator 38 to start producing the desired vibration frequency signal upon elapse of a preassigned length of time following the moment the piston 14 of the press 10 starts travelling on its power stroke.

The reference pressure signal from the signal generator section 32 enters the servo amplifier 46 of the servo control section 36, and is thereby amplified and directed to the servovalve 22 for electromagnetically actuating the same. The servovalve 22 first places the pump 24 in communication with the upper fluid chamber 16 of the pump 10, thereby causing the descent of the piston 14 with the ram 20 for the exertion of pressure on the mixture in the mold.

When the pressure on the mixture in the mold rises to a required value, the output signal of the servo control section 36 starts to cause the servovalve 22 to shift alternately to its right and left hand offset positions at rapid intervals prescribed by the frequency of the reference pressure signal from the signal generator section 32. The rapid, repeated shifting of the servovalve 22 between its two offset positions results in the alternate delivery of the pressurized fluid from the pump 24 into the opposite fluid chambers 16 and 18 of the press 10 at rapid intervals and, accordingly, in the rapid reciprocation of the piston 14 with the ram 20. The rapid reciprocation of the ram 20 can be thought of as a kind of vibration, which is imparted to the mixture in the mold. Thus subjected to vibration from the press 10 while being held under pressure, the mixture is rapidly compacted to a required degree of bulk specific gravity.

During the above process of compaction, the pressure sensor 34 senses the pressure being exerted by the press 10 from the pressure of the fluid flowing through the conduit 28 and puts out the actual pressure signal for delivery to the servo control section 36. Amplified by the amplifier 44, the actual pressure signal is directed to the servo amplifier 46, to which there is also supplied the reference pressure signal from the signal generator section 32. The servo amplifier 46 controls the servovalve 22 in accordance with the difference between the reference and actual pressure signals so as to make this difference zero by making the actual pressure signal equal to the reference pressure signal. It is thus seen that the servomechanism functions to cause the press 10 to operate exactly under the conditions dictated by the signal generator section 32.

EXAMPLE

Some different particle size groups of magnesium oxide (MgO) were mixed with graphite in proportions set forth in Table 1 below, to prepare sample mixtures A and B to be processed into firebricks in accordance with the teachings of the present invention. In this table, the proportion of graphite is given in percent by weight with respect to the total amount of MgO of the different particle sizes.

TABLE 1

| Sample Compositions | | | |
|---|---|---|---|
| | | Sample | |
| Ingredient | Particle Size (mm) | A (wt. %) | B (wt. %) |
| MgO | 1.0–3.0 | 60 | — |
| " | 0.3–1.0 | 20 | 60 |
| " | Less than 0.3 | 20 | 40 |
| Graphite | — | *20 | *20 |

*percent by weight with respect to the total amount of MgO

The above mixtures A and B were processed into common refractory firebricks, sized 230 by 114 by 65 millimeters, by the use of a 1,500-ton hydraulic press under various conditions as described below.

Figure 2:
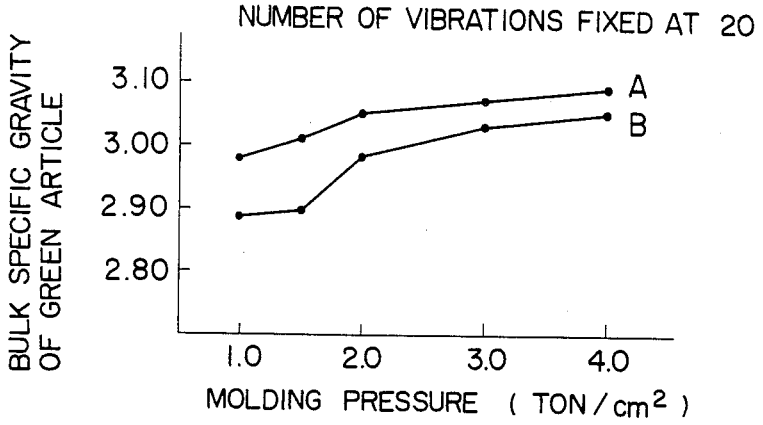
FIG. 2 is a graph showing curves of the bulk specific gravities of some firebricks manufactured in accordance with the invention plotted against the molding pressures that have been exerted thereon, with the number of vibrations imparted thereto fixed at 20.

As the first experiment, the initial pressure exerted on the mixtures was set at various values from 1.0 to 4.0 tons per square centimeter, with the number of vibrations or reciprocations of the ram fixed at 20. FIG. 2 gives the results, graphically representing the bulk specific gravities of the firebricks molded from the mixtures A and B against the molding pressures.

The second experiment was to vary the number of vibrations, from one (no vibration) up to 25, with the initial pressure fixed at 1.5 tons per square centimeter. The results were as graphically represented in FIG. 3, in which the bulk specific gravities of the firebricks molded from the mixtures A and B are plotted against the various numbers of vibrations that were imparted thereto.

Figure 4:
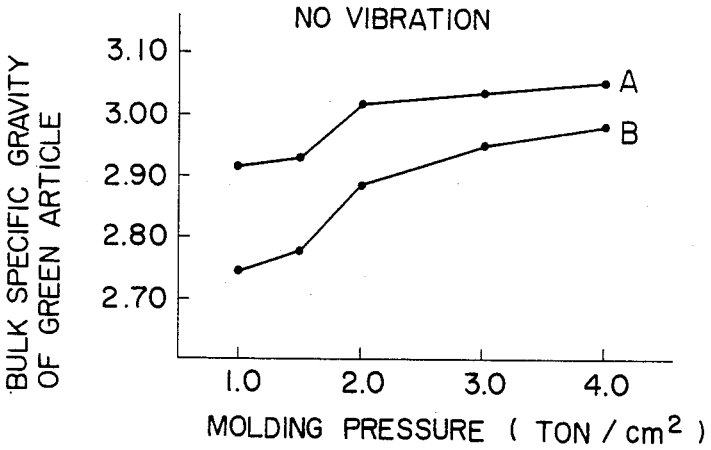
FIG. 4 is a graph showing curves of the bulk specific gravities of the firebricks plotted against the molding pressures that have been exerted thereon, with no vibration imparted thereto.

The third and final experiment ran counter to the teachings of this invention: No vibration was imparted, and only the molding pressure was set variously from 1.0 to 4.0 tons per square centimeter. FIG. 4 graphically represents the results as the bulk specific gravities of the firebricks molded from the mixtures A and B plotted against the molding pressures.

Figure 3:
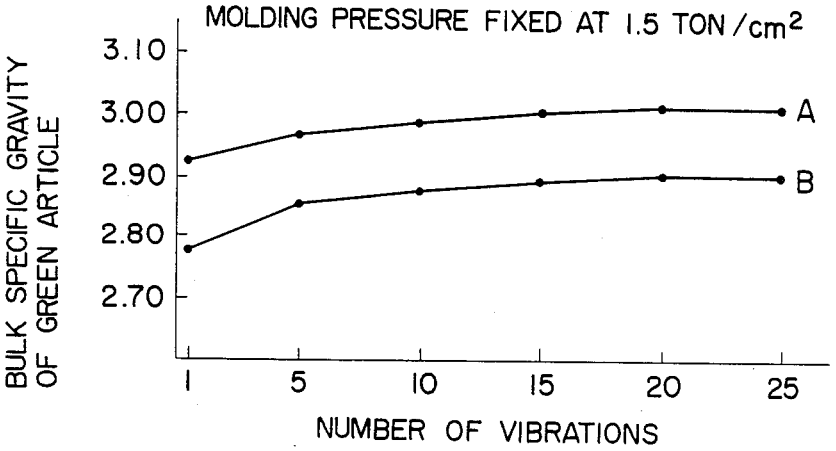
FIG. 3 is a graph showing curves of the bulk specific gravities of the firebricks plotted against the number of vibrations that have been imparted thereto, with the molding pressure fixed at 1.5 tons per square centimeter.

The results of FIGS. 2 and 3 demonstrate that the application of high molding pressures and vibrations in accordance with the invention results in the production of firebricks of materially higher bulk specific gravities than those of the firebricks of FIG. 4 that have been subjected to no vibration. The exertion of 20 vibrations (piston reciprocations) normally suffices for practical purposes. Since the apparatus of FIG. 1, including the servovalve 22, makes it possible to cause the press 10 to make one vibration in 1.0 to 1.5 seconds, one firebrick can be pressed to a sufficiently high degree of bulk specific gravity in 20 to 30 seconds.

Table 2 represents by way of comparison the periods of time required for bumping or vibration, handling, evacuation, and the sum of such periods, in the production of firebricks of like physical properties by this invention and by the prior art friction press and bumping hydraulic press. Each press tested was furnished with evacuation facilities, and 20 blows or vibrations were applied to the mixture in the mold under the same maximum pressure.

TABLE 2

| Comparison of Operating Periods Invention versus Prior Art | | | | |
|---|---|---|---|---|
| | Bumping or Vibration Time | Handling Time | Evacuation Time | (sec.) Total Molding Time |
| Friction Press (Prior Art) | 50–70 | 30–40 | 10–15 | 90–125 |
| Bumping Hydraulic Press (Prior Art) | 100–120 | 30–40 | 10–15 | 140–175 |
| Invention | 20–30 | 30–40 | 10–15 | 60–85 |

Table 3 compares the characteristics of the present invention with those of the prior art friction press and bumping hydraulic press.

TABLE 3

| Comparison of Performance Characteristics Invention versus Prior Art | | | |
|---|---|---|---|
| | Friction Press (Prior Art) | Bumping Hydraulic Press (Prior Art) | Oil Press of Invention |
| Pressing Method | Mechanical Impact Force | Semistatic Impact Force | Pressure & Vibration |
| Molding Time | Medium | Long | Short |
| Increase in Size of Machine | Difficult | Easy | Easy |
| Energy Loss | Much | Little | Little |
| Vibration & Noise | Much | Little | Little |
| Brick Quality (Same pressure) | Excellent | Good | Excellent |

Tables 2 and 3 clearly demonstrate the advantages of this invention over the prior art that is believed to be closest to the present invention.

What is claimed is:

1. An apparatus for pressure molding firebrick, comprising:

(a) a press having opposed first and second fluid chambers to be selectively pressurized for respectively exerting pressure on, and releasing the pressure from, a mixture of desired brick ingredients in the form of fine particles in a mold;

(b) a source of fluid under pressure in selective communication with said fluid chambers;

(c) a directional control valve for selectively placing the opposed fluid chambers of the press in and out of communication with the pressurized fluid source and with a fluid drain; and (d) control means for actuating the directional control valve to subject the mixture to vibratory motion from the press while being held under a prescribed pressure, said control means initially actuating said valve to place said pressure source in communication with said first fluid chamber and direct the pressurized fluid from the source to the first fluid chamber until the press exerts the prescribed pressure on the mixture, said control means maintaining the mixture under the prescribed pressure and subsequently actuating said valve at rapid intervals to direct the pressurized fluid from the source to alternate fluid chambers of the press to compact the mixture rapidly to a required degree.

2. The apparatus of claim 1 wherein the directional control valve includes a torque motor for electromagnetically translating an electric pilot signal into mechanical movement, and wherein the means for actuating the directional control valve comprises:

(a) an oscillator for generating an electric output signal of variable frequencies; and (b) a controller for controlling the output signal of the oscillator prior to delivery to the directional control valve in order to determine factors to be represented by the oscillator output signal as the pressure to be exerted by the press on the mixture of the brick ingredients, and the intervals at which the pressurized fluid is to be alternately directed into the opposite fluid chambers of the press.

3. An apparatus for pressure molding firebrick, comprising:

(a) a press having opposed first and second fluid chambers to be selectively pressurized for respectively exerting pressure on, and releasing the pressure from, a mixture of desired brick ingredients in the form of fine particles in a mold;

(b) a source of fluid under pressure;

(c) a servovalve for selectively placing the opposed fluid chambers of the press in and out of communication with the pressurized fluid source and with a fluid drain;.

(d) signal generator means for generating a reference pressure signal representative of a prescribed pressure to be exerted by the press on the mixture by the delivery of the pressurized fluid from the source to the first fluid chamber of the press via the servovalve, the reference pressure signal being further representative of a frequency with which the mixture is to be subjected to vibratory motion by the press, while being thereby held under approximately the prescribed pressure, by the delivery of the pressurized fluid from the source alternately to the opposite fluid chambers of the press at rapid intervals via the servovalve;

(e) a pressure sensor for generating an actual pressure signal representative of the actual pressure being exerted by the press on the mixture; and (f) servo control means for actuating the servovalve in accordance with the difference between the reference and actual pressure signals, so as to make this difference zero.

4. The apparatus of claim 3 wherein the signal generator means comprises:

(a) an oscillator for generating an electric signal of variable frequencies and waveforms; and (b) a controller for controlling the output signal of the oscillator prior to delivery to the servo control means in order to determine such factors to be represented by the oscillator output signal as the pressure to be exerted by the press on the mixture of the brick ingredients and the intervals at which the pressurized fluid is to be alternately directed into the opposite fluid chambers of the press.

5. The apparatus of claim 3 wherein the pressure sensor is provided to detect the pressure within a fluid conduit extending between the servovalve and the first fluid chamber of the press.

* * * * *